US011529004B2

(12) United States Patent
Madueke

(10) Patent No.: US 11,529,004 B2
(45) Date of Patent: Dec. 20, 2022

(54) WIG STORAGE SYSTEM

(71) Applicant: Ugonna Madueke, Lagos (NG)

(72) Inventor: Ugonna Madueke, Lagos (NG)

( * ) Notice: Subject to any disclaimer, the term of this patent is extended or adjusted under 35 U.S.C. 154(b) by 73 days.

(21) Appl. No.: 16/809,546

(22) Filed: Mar. 4, 2020

(65) Prior Publication Data

US 2020/0281374 A1 Sep. 10, 2020

Related U.S. Application Data

(60) Provisional application No. 62/813,248, filed on Mar. 4, 2019.

(51) Int. Cl.
*A47F 7/06* (2006.01)
*A45C 11/00* (2006.01)

(52) U.S. Cl.
CPC ..... *A47F 7/065* (2013.01); *A45C 11/00* (2013.01)

(58) Field of Classification Search
CPC ..... A47F 7/065; A45C 11/00
USPC ..... 211/30
See application file for complete search history.

(56) References Cited

U.S. PATENT DOCUMENTS 275,581 A * 4/1883 Bundy ..... A47G 25/10 211/30
600,599 A * 3/1898 Slattery ..... A47G 25/10 211/30
629,154 A * 7/1899 Easton ..... A47G 25/10 211/30
740,734 A * 10/1903 Bishop ..... A47G 25/10 211/30
1,471,191 A * 10/1923 Niebler ..... A47F 7/06 211/30
1,516,024 A * 11/1924 Meyer ..... A47G 25/10 211/30
1,655,609 A * 1/1928 James ..... A47G 25/10 211/30
2,574,557 A * 11/1951 Johnp ..... A47G 25/743 211/30
2,720,984 A * 10/1955 Gotowka ..... A47G 25/10 211/30
2,889,935 A * 6/1959 Thornburg ..... A47G 25/10 211/30
2,994,436 A * 8/1961 Stull ..... B60R 7/10 211/30
3,603,489 A * 9/1971 Fleisher ..... A45D 44/14 223/66
9,339,138 B2 * 5/2016 Eslami ..... A47G 25/483
9,441,785 B2 * 9/2016 Sterling ..... A47G 25/24
10,010,157 B2 * 7/2018 Drain ..... F16B 45/00
(Continued)

FOREIGN PATENT DOCUMENTS

DE 2626307 A1 * 12/1977 ..... A45D 44/14
GB 1151455 A * 5/1969 ..... A45D 44/14
(Continued)

*Primary Examiner* — Stanton L Krycinski
(74) *Attorney, Agent, or Firm* — Diana Mederos; Mederos Legal, PLLC

(57) ABSTRACT

A wig storage system comprising a wig clip hanger and a protective storage case. The wig clip hanger holds a wig without damaging or ruining the shape of the wig and prevents the wig from slipping out of place. A corresponding protective storage case accommodates the wig while attached to the wig clip hanger. The storage case closes around the wig, protecting it from dirt, moisture, and tangling.

3 Claims, 3 Drawing Sheets

(56) References Cited

U.S. PATENT DOCUMENTS

| | | | | |
|---|---|---|---|---|
| 10,117,486 | B2 * | 11/2018 | Cook | A45D 44/14 |
| 10,117,535 | B2 * | 11/2018 | Wood | A47F 7/06 |
| 2016/0262560 | A1 * | 9/2016 | Fields | A47F 7/065 |
| 2018/0008074 | A1 * | 1/2018 | Park | A47G 25/485 |
| 2020/0015606 | A1 * | 1/2020 | Ji | A45D 44/14 |
| 2021/0015285 | A1 * | 1/2021 | Johnston | A47G 29/00 |

FOREIGN PATENT DOCUMENTS

| | | | |
|---|---|---|---|
| KR | 200471619 | Y1 * | 3/2014 |
| KR | 20140001950 | U * | 4/2014 |

* cited by examiner

WIG STORAGE SYSTEM

PRIORITY CLAIM

This application claims the benefit of U.S. provisional application No. 62/813,248, entitled Wig Storage System and having a filing date of Mar. 4, 2019, in its entirety.

FIELD OF THE DISCLOSURE

The present disclosure relates to a wig storage system. More specifically, the present disclosure presents a portable, protective storage system for wigs through the use of a specialized wig clip hanger and a corresponding protective storage case and methods of use.

BACKGROUND OF THE DISCLOSURE

Wigs are a popular and relatively easy way for someone to change his/her look. Many people wear wigs out of necessity due to health reasons or simply due to aesthetic and vanity reasons. Wigs can be made from human hair or synthetic hair, and high quality wigs can last more than one year. High quality wigs made from human hair can cost thousands of dollars. Therefore, the care and storage of such wigs is important for getting the most use out of the wig.

Traditionally, wigs are stored in either a box, a collapsible hanger, or on a model head and placed on a shelf. None of these storage options will adequately protect the wig during travel. There are some wig travel storage boxes available with a dome insert and wig mounts, but such boxes and inserts do not hold the wig in place to prevent tangling. Wig travel boxes are also large and bulky which can be problematic when the person traveling has limited allotment for luggage.

Special care needs to be taken to preserve the delicate construction that makes the best wigs look the most natural. For example, the underside of a wig that rests along the scalp is called a cap. The cap can be constructed in various ways. Standard and cap-less wigs are priced lower and look the least natural. The cap will have strips of hair sewn with alternating openings to allow for breathability. The hair strips are delicate and can easily be damaged or tangled. Wigs with a monofilament construction are higher quality and contain a thin nylon mesh fabric base that blends in with the scalp's natural color. Hand knotted wigs provide a natural scalp and hair strand look around the cap edges and at the crown where hair is parted. Lace front wigs are the most sophisticated and delicate where each strand of hair is sewn to a nylon lace cap. The nylon blends around the hairline, providing the most natural look.

Due to the delicate caps that many wigs have, it is essential to store the wigs to protect the shape and prevent tangles, avoid dust and moisture, and to prevent the caps from ripping.

SUMMARY OF THE DISCLOSURE

What is needed is the wig storage system of the disclosure. The wig storage system comprises a wig clip hanger and a storage case. The wig clip hanger has a hook end, a neck, a sigmoidal portion, a clip portion, a linear cross bar, and a flared end with a flat bottom portion. A wig is placed on the wig clip hanger by separating the linear cross bar up and away from the flat bottom portion, sliding the front of the wig onto the flat bottom portion and sliding the wig toward the back of the flared end so the linear cross bar will lie along the wig center part line. The hanger and wig are placed in a storage case having a hook hole, a window pocket, at least one interior pocket, and at least one interior loop for storage of accessories and brushes. The storage case is opened and closed with fasteners. An exterior loop can be looped over the hook protruding from the hook hole. The wig storage system securely holds delicate lace-front wigs.

BRIEF DESCRIPTION OF THE DRAWINGS

The accompanying drawings that are incorporated in and constitute a part of this specification illustrate several embodiments of the disclosure and together with the description serve to explain the principles of the disclosure.

REFERENCE NUMERALS OF THE DRAWINGS

Figure 1A:
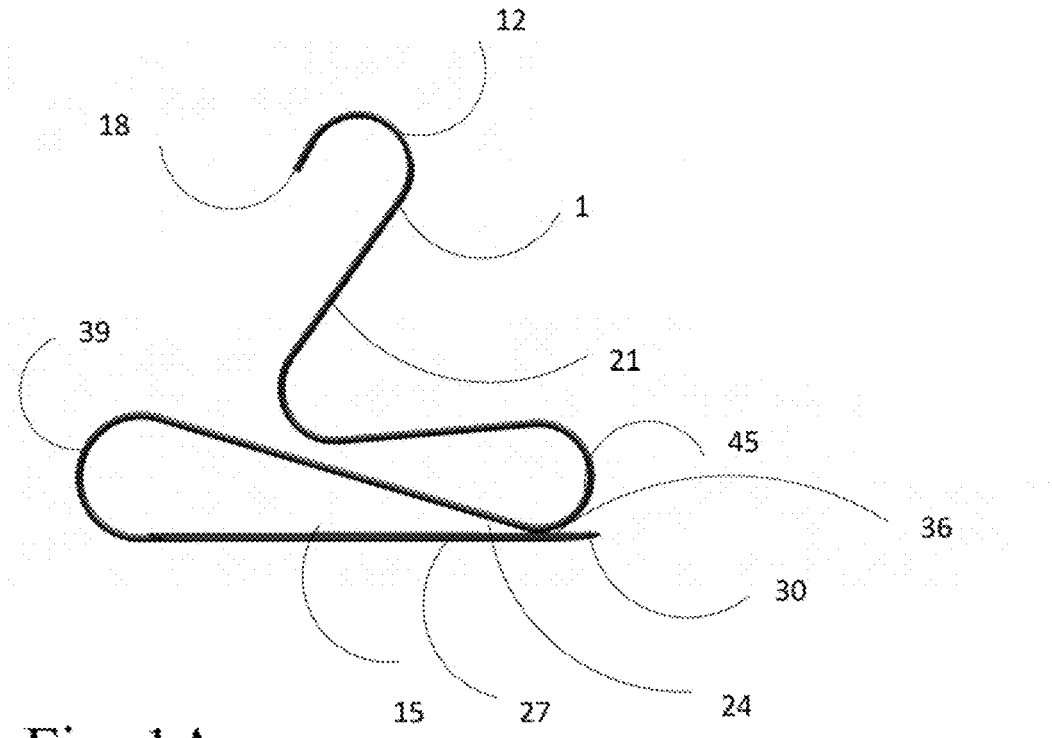
FIG. 1A shows a side view of an exemplary wig clip hanger.

1. Wig clip hanger
3. Flared end
6. Edge
9. Grip portion
12. Hook end
15. Clip end
18. Hook
21. Neck portion
24. Clip portion
27. Clip bottom portion
30. Clip lip
33. Clip flat bottom
36. Tapered opening
39. Back of the flared end
42. Tapered end
43. Linear cross bar
45. Sigmoidal hanger portion
48. Storage case
51. Wig holding interior space
54. Opening
57. Fastener
60. Hook hole
63. Window pocket
66. Interior pocket
67. Interior surface
69. Exterior surface
72. Exterior loop
75. Interior loop

DETAILED DESCRIPTION

The present disclosure provides generally for a wig storage system that allows a wig owner to protect each wig from the elements, tangles, and cap rips while preserving the quality and value of the wig. The wig storage system can be used for stationary storage or on-the-go storage. The wig storage system comprises a specially shaped wig clip hanger. The wig clip hanger can be used with a protective storage case. The present disclosure provides apparatuses and methods for protecting wigs, especially wigs with delicate caps such as lace caps.

In the following sections, detailed descriptions of examples and methods of the disclosure will be given. The description of both preferred and alternative examples are exemplary only, and it is understood that to those skilled in the art that variations, modifications, and alterations may be apparent. It is therefore to be understood that the examples do not limit the broadness of the aspects of the underlying disclosure as defined by the claims.

Referring now to FIG. 1A, an exemplary wig clip hanger is shown. An exemplary wig clip hanger has a hook end and a clip end. The hook end at the top provides for a curvature structure to rest the hanger on a rod or other hook to allow hanging. The hook may swivel about a neck portion. The neck portion connects into the clip portion. The clip portion may have a short, wide sigmoid configuration with a tapered open end and a flared end. The clip portion has a bottom portion with a lip and flat bottom.

In some embodiments, the wig clip hanger may be constructed from a single, continuous piece or multiple pieces. The hook portion may or may not have swivel capabilities. In some embodiments, the wig clip hanger may be constructed from a rigid but somewhat flexible metal such as aluminum or tin. The weight of a wig should not cause the wig clip hanger to bend, and the wig hanger clip should have sufficient strength to hold a wig weighing at least 3 kilograms without bending or buckling. The bottom portion of the wig clip hanger should be substantially flat to provide a base for the wig cap interior to lay on and be supported.

In some embodiments, the wig clip hanger may have a polymer coating to either increase or decrease friction or both. For example, the tapered end may be coated with a texture to help frictionally secure the wig cap and prevent it from coming loose from the wig clip hanger. However, other parts such as at the bottom portion may have a slick coating to promote sliding the wig securely toward the back of the flared end.

The overall sigmoid shape of the wig clip hanger not only serves to hold the wig securely in place while minimizing damage but also serves to balance the weight, so the hanger and wig will be held substantially straight rather than lopsided. A wig clip hanger may have a height of about 7 inches, a width of about 8 inches, and a depth at the bottom portion from about 0.8 inches to about 1.7 inches. The hanger itself may have a diameter of approximately 0.12 inches.

Figure 1B:
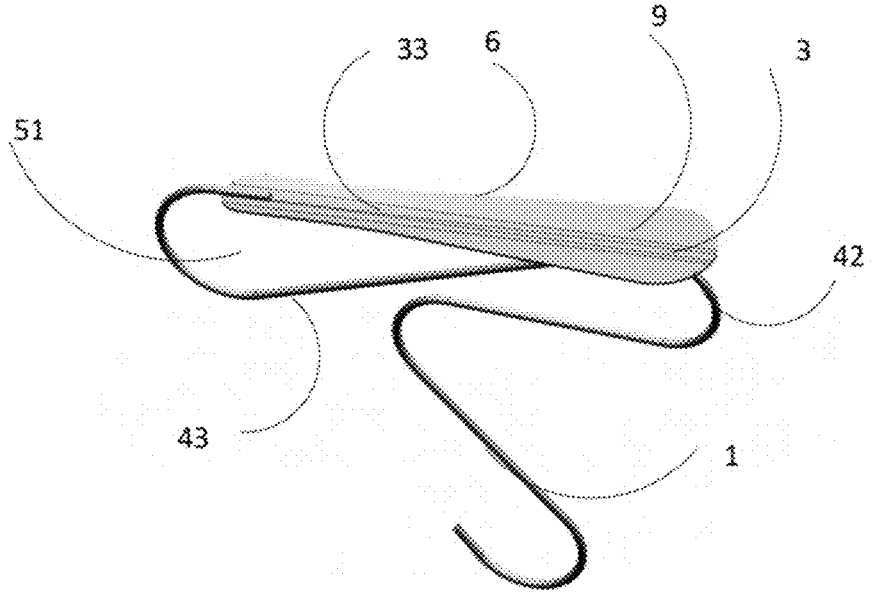
FIG. 1B shows an upside-down or bottom perspective view of an exemplary wig clip hanger.

Referring now to FIG. 1B, an upside-down view of an exemplary wig clip hanger is shown. In the exemplary embodiment, the flared end and tapered end are evident. The tapered end is connected to the sigmoidal hanger portion whereby the hanger portion is either removably or fixedly attached to the base having a tapered end and flared end. A wig may be slid onto the base portion at the flared end which will provide support. The hanger portion may be attached to the base portion with an adhesive, by welding, or may be slid into an optional sheath portion on the bottom of the base portion. The base portion may be rigid or may be flexible. The base portion may have additional shapes or protrusions to aid in holding a wig in place and to minimize damage to the wig.

The flared end of the base may have beveled, straight, or rounded edges. The edges may be contoured to aid in keeping the wig in place and minimizing damage. In embodiments where the base is flexible or semi-rigid, the base may be bent or molded to a different shape or angle to accommodate wigs that may be more or less voluminous than average. The flared end may have at least one or a plurality of grip portions. The grip portions may be polygonal or linear. The grip portions along with the sigmoidal end of the hanger portion may serve to aid in wig storage or improve grip onto the underside or lace portion of the wig. Grip portions may be made out of rubber, plastic, sticky tack, or other polymer to help hold the wig in place. The grip portion may be an integrated or add-on material.

Figure 2A:
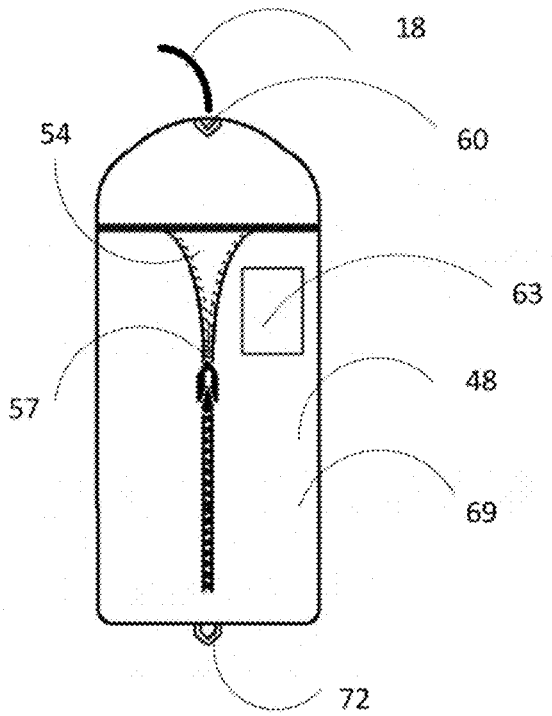
FIG. 2A shows a front exterior view of an exemplary storage case.
Figure 2B:
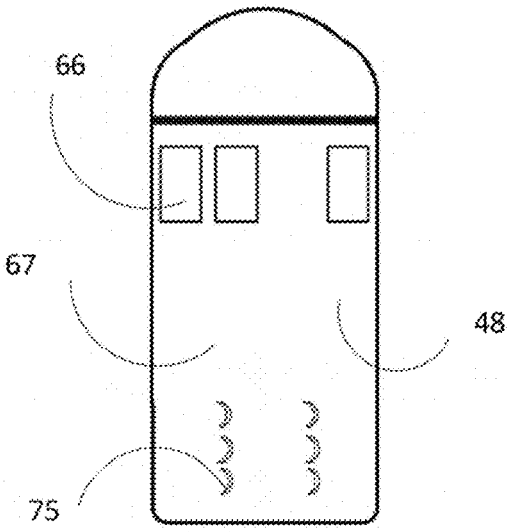
FIG. 2B shows a front interior view of an exemplary storage case.
Figure 2C:
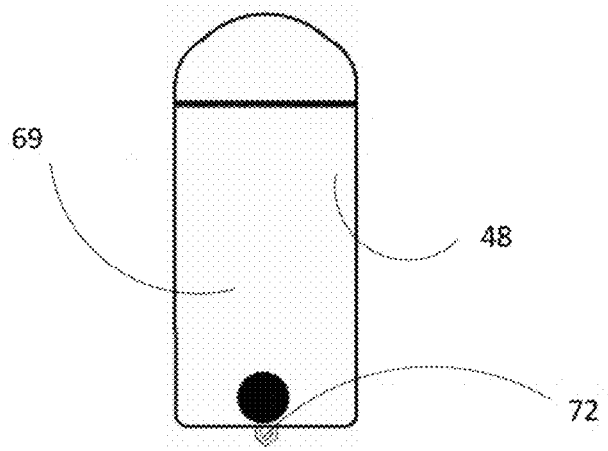
FIG. 2C shows a rear exterior view of an exemplary storage case.

Referring now to FIGS. 2A, 2B, and 2C, an exemplary protective storage case is shown with the respective front, interior, and rear views. An exemplary storage case may be soft bodied and have an opening that may be opened and closed with fasteners such as buttons, hook-and-loop closures, or zippers. The storage case is defined by an exterior surface and an interior surface revealed by the opening. The storage case is opened, and the wig secured to the wig clip hanger is placed inside the bag with the hook threaded through a hook hole or opening, so the hook is accessible outside of the storage case. The storage case may be hung on a hook, knob, or rod. The storage case may be constructed from canvas or a woven material such as cotton, polyester, combinations thereof, or any natural or synthetic fabric. The storage case may have an additional lining to protect the wig from moisture.

A storage case has an exemplary measurement of 28 inches long by 11 inches wide and is substantially flat when empty. On the front exterior, there is the opening which may run longitudinally and a window pocket. The window pocket could be left alone to provide a preview of the wig being stored inside or may be used to place an identification or wig detail card. Inside the exemplary storage case, there may be a plurality of interior pockets. The pockets may serve to hold wig accessories such as spray, tape, brush, comb, and other accessories such as scarves, hairpins, elastics, and shower caps. In some embodiments, a series or plurality of interior loops may be present for additional storage options.

Figure 3A:
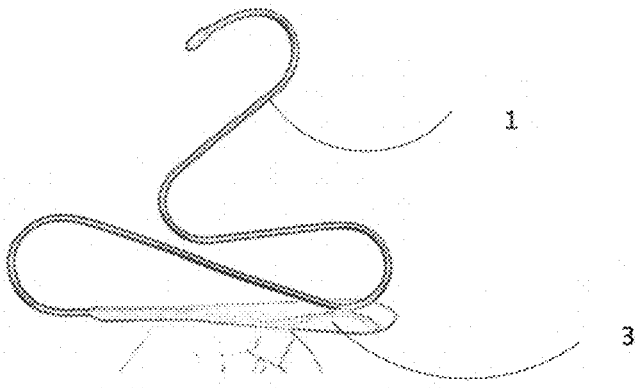
FIG. 3A shows a side view of a resting position of usage of an exemplary wig clip hanger.
Figure 3B:
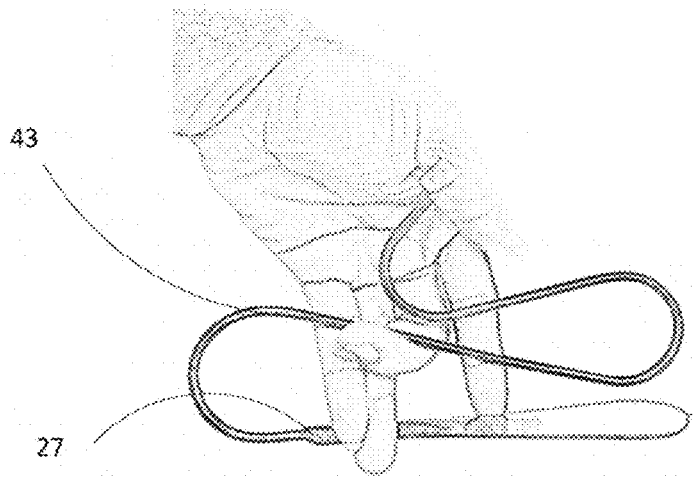
FIG. 3B shows a side view of an opening position of usage of an exemplary wig clip hanger.
Figure 3C:
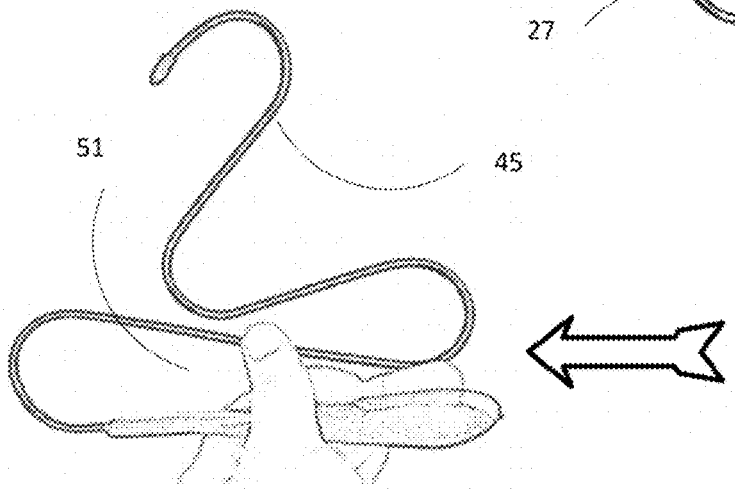
FIG. 3C shows a side view of a tightening position of usage of an exemplary wig clip hanger.

Turning now to FIGS. 3A, 3B, and 3C, exemplary usage method steps are illustrated to show the side views of the resting position, the opening position, and the tightening position, respectively. The system is specifically designed to securely yet gently hold delicate lace-front wigs in place. In order to secure a wig on a clip hanger, a person should grab the linear cross bar and sigmoidal parts of the hanger and press down on the bottom portion flat bottom. The goal is to pull the tapered opening at the clip end away from the flat bottom of the bottom portion to expand the wig holding space to accommodate a wig. The lip of the bottom portion is inserted at the front of the wig, and the wig is slid over and along the flat bottom portion of the clip portion and toward the back of the flared end. In preferred embodiments, the crown or top interior of the wig should cover the flared end flat bottom of the clip portion. The tapered end is lowered on top of the wig and should align to the top rear of the crown of the wig. The linear cross bar should align with a center part along the top of the wig. The flat bottom of the clip portion and the linear cross bar can be squeezed or compressed or further pulled apart to accommodate wigs of varying thickness and to promote grip and security of the wig.

CONCLUSION

A number of embodiments of the present disclosure have been described. While this specification contains many specific implementation details, these should not be construed as limitations on the scope of any disclosures or of what may be claimed but rather as descriptions of features specific to particular embodiments of the present disclosure.

Certain features that are described in this specification in the context of separate embodiments can also be implemented in combination in a single embodiment. Conversely, various features that are described in the context of a single embodiment can also be implemented in combination in multiple embodiments separately or in any suitable subcombination.

Thus, particular embodiments of the subject matter have been described. Other embodiments are within the scope of the following claims. In some cases, the actions recited in the claims can be performed in a different order and still achieve desirable results. Various modifications may be made without departing from the spirit and scope of the claimed disclosure.

What is claimed is:

1. A method of storing and protecting a wig with a wig storage system, the system comprising a wig clip hanger having a hook, a neck portion, a sigmoidal hanger portion, a linear cross bar, wig holding space, and a clip portion, wherein the clip portion comprises a clip end, a tapered opening, a flared end, a tapered end, and a bottom portion, wherein the bottom portion comprises a flat bottom, a lip, and a grip portion, and wherein the grip portion is made of rubber and has a linear configuration, the method steps comprising:

obtaining a wig;

holding the front of the wig to the tapered opening of the wig clip hanger, sliding the wig between the flat bottom and the tapered opening, prying the tapered opening to allow the wig to slide onto the flat bottom, moving the wig toward the end of the flared portion, grasping the hook, placing the wig and wig clip hanger into an open protective storage case, threading the hook end through a hook hole of the protective storage case, and closing the protective storage case.

2. The method of claim 1 further comprising bringing an exterior loop up toward the hook from the hook hole and threading the hook through the exterior loop.

3. The method of claim 1 further comprising compressing together the linear cross bar and the flat bottom of the clip portion of the wig clip hanger to increase wig grip.

* * * * *